US008438977B2

(12) United States Patent
Paulic et al.

(10) Patent No.: US 8,438,977 B2
(45) Date of Patent: May 14, 2013

(54) PROJECTILE HAVING DEPLOYABLE FIN

(75) Inventors: Antonio Paulic, Arlington, VA (US); Robert M. Krass, Ashburn, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 1174 days.

(21) Appl. No.: 12/344,245

(22) Filed: Dec. 25, 2008

(65) Prior Publication Data

US 2011/0308418 A1 Dec. 22, 2011

(51) Int. Cl.
*F42B 15/22* (2006.01)
*F42B 15/01* (2006.01)

(52) U.S. Cl.
USPC ..... 102/399; 244/3.24; 244/3.27

(58) Field of Classification Search ..... 244/3.24, 244/3.27, 3.28, 3.3, 3.29; 102/399
See application file for complete search history.

(56) References Cited

U.S. PATENT DOCUMENTS

| | | | | |
|---|---|---|---|---|
| 2,460,289 | A | 2/1949 | Hickman | |
| 3,162,163 | A | 12/1964 | Silverman | |
| 3,627,233 | A | 12/1971 | Jacobson et al. | |
| 3,677,179 | A * | 7/1972 | Potteiger et al. | 102/473 |
| 4,869,442 | A * | 9/1989 | Miller | 244/3.28 |
| 5,082,203 | A * | 1/1992 | Baubry | 244/3.28 |
| 5,235,930 | A | 8/1993 | Pendleton | |
| 5,584,448 | A * | 12/1996 | Epstein et al. | 244/3.28 |
| 5,834,684 | A * | 11/1998 | Taylor | 244/3.28 |
| 5,929,370 | A * | 7/1999 | Brown et al. | 102/399 |
| 5,955,698 | A * | 9/1999 | Harkins et al. | 102/399 |
| 5,988,071 | A * | 11/1999 | Taylor | 244/3.28 |
| 6,021,716 | A * | 2/2000 | Taylor | 244/3.28 |
| 6,073,879 | A * | 6/2000 | Sokolovsky et al. | 244/3.28 |
| 6,073,880 | A * | 6/2000 | Voigt et al. | 244/3.28 |
| 6,168,111 | B1 | 1/2001 | Kayser et al. | |
| H1938 | H * | 2/2001 | Harkins et al. | 102/399 |
| 6,314,886 | B1 * | 11/2001 | Kuhnle et al. | 244/3.28 |
| 6,739,266 | B1 * | 5/2004 | Castano et al. | 102/399 |
| 7,347,146 | B1 * | 3/2008 | Gieseke | 102/399 |
| 2001/0039898 | A1 * | 11/2001 | Bar et al. | 244/3.28 |
| 2007/0002475 | A1 * | 1/2007 | Fowler et al. | 359/858 |

OTHER PUBLICATIONS

Max R. Popenker, "RPG-28 antitank disposable grenade launcher / rocket-propelled grenade", "http://world.guns.ru/grenade/gl42-e.htm", 1999-2008.

* cited by examiner

*Primary Examiner* — Michael Carone
*Assistant Examiner* — Steven Hawk
(74) *Attorney, Agent, or Firm* — Kaplan Breyer Schwarz & Ottesen, LLP

(57) ABSTRACT

A supercavitating projectile is disclosed that has deployable fins. The fins are pivotally coupled to the body of the projectile. The fins have two primary states: stowed within a recess at the surface of the projectile and deployed to a radially-extended position relative to the body of the projectile. The fins deploy as the projectile leaves its launch tube. The fins function as a control surface, interacting with the wall of the vapor cavity in which the supercavitating projectile travels.

13 Claims, 6 Drawing Sheets

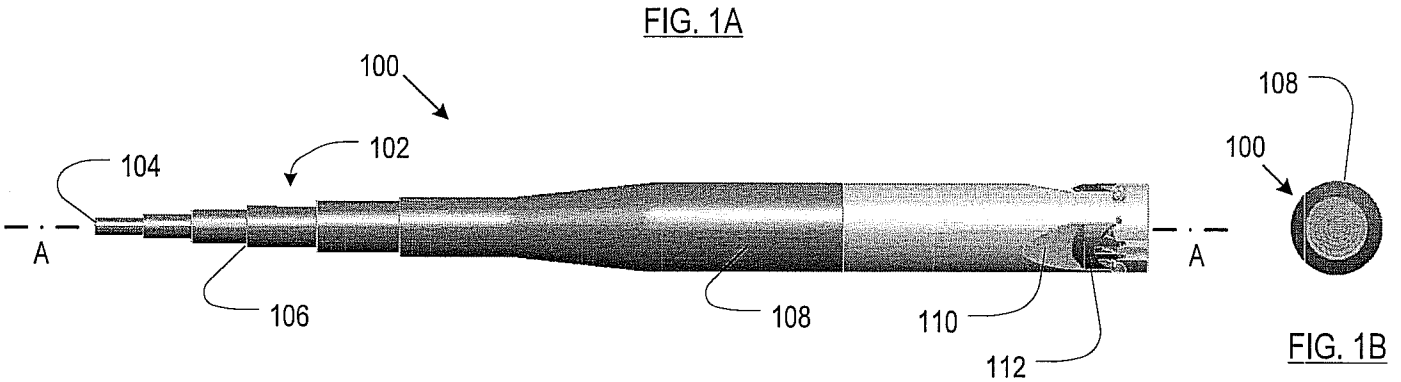
FIG. 1A
FIG. 1B
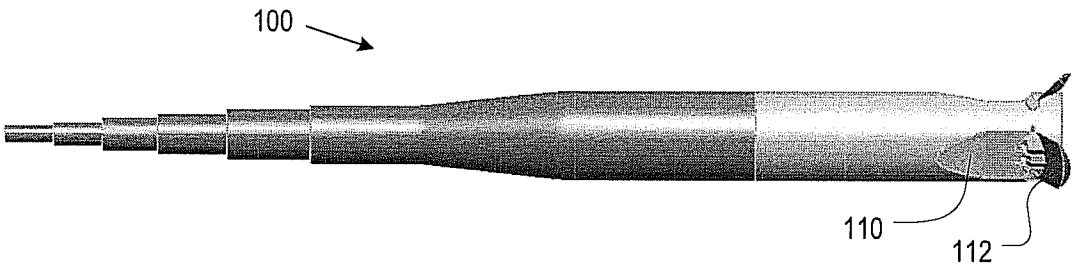
FIG. 2A
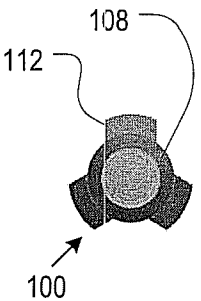
FIG. 2B

PROJECTILE HAVING DEPLOYABLE FIN

STATEMENT REGARDING FEDERALLY-SPONSORED RESEARCH

This invention was made with Government support under Contract #N00014-07-C-1103, and the Government has certain rights in the invention.

FIELD OF THE INVENTION

The present invention relates to underwater projectiles.

BACKGROUND OF THE INVENTION

Underwater gun systems are being developed for naval warfare. These systems often use an energetic propellant to launch a projectile from a launch tube. A challenge to the development of effective underwater guns is that a projectile traveling through water experiences a resistance or drag that is approximately one thousand times greater than the resistance experienced by the projectile traveling through air. As a consequence of this high level of drag, conventional underwater projectiles are limited to speeds of no more than about 80 kilometers/hour (km/h).

The high resistance presented by the water medium can be addressed via a phenomenon known as "supercavitation." This phenomenon can occur when a projectile having a blunt nose travels at sufficiently high speeds under water. The blunt nose pushes aside water as the projectile advances. When the hydrodynamic pressure of water that is pushed aside overcomes the ambient static pressure, water vaporizes. The vaporized water forms air bubbles, which coalesce to form a "cavity" in the water. If enough bubbles are formed, the cavity will be large enough to completely engulf the projectile, with the exception of the blunt tip of the nose. This characterizes the supercavitating mode of operation, which is also referred to as "cavity-running" operation).

Within the vaporous cavity, the projectile is effectively traveling through air rather than water. The projectile, therefore, experiences greatly reduced drag. As a consequence, the projectile is capable of attaining a velocity far in excess of what is possible when traveling through water proper.

Supercavitating projectiles often collide with the walls of the enveloping cavity, which increases drag. This can be addressed by equipping the projectile with fins. When a fin contacts the cavity wall, a torque develops that steers the projectile toward the center of the cavity into a region of lower drag.

The fins are usually located in the aft section of the projectile body and project radially outward therefrom. The radially-extending fins prevent the projectile from being tightly packaged within a launch tube. This drawback is addressed by coupling the projectile to a sabot, which is a carrier that centers the projectile within the launch tube and falls off after launch. Use of a sabot disadvantageously increases the amount of energetic propellant required for launch and also requires an increase in launcher size. A need therefore exists for an improved supercavitating projectile that retains the in-cavity stability of known fin designs but does not require a sabot for launch.

SUMMARY OF THE INVENTION

Some embodiments of the present invention provide an improved design for an underwater projectile that is capable of operating in a supercavitating mode.

In accordance with the illustrative embodiment, a fin is pivotally coupled to the cylindrical body of the projectile. This pivotal coupling enables the fin to either (1) stow itself within a recess at the surface of the projectile or (2) deploy to a radially-extended position.

When stowed, substantially no portion of the fin protrudes beyond the circumference of the body of the projectile. In this stowed state, the projectile can be packaged inside of a launch tube or barrel without the use of a sabot. Furthermore, the fin is disposed forward of the aft end of the projectile of the booster base of the projectile. This enables multiple such projectiles to be "stacked" nose to tail within a barrel, such as in a stacked launcher configuration disclosed in U.S. Published Patent Application 2008/0022879, which is incorporated by reference herein. In this fashion, the projectile can be launched using an energetic propellant disposed within the launch tube (as per the referenced published patent application) or within the projectile.

Upon launch, the projectile enters the water and travels through it until a vaporous cavity is formed. In some embodiments, the water drag experienced by the projectile immediately following launch causes the fins to pivot to the deployed position. In some other embodiments, deployment via water drag is supplemented by a spring-biasing element that is used to initiate pivoting of the fins.

Once deployed, the fins operate in substantially the same manner as fixed-fin designs known in the prior art. In particular, the fins function as a control surface, interacting with the wall of the cavity in which the projectile travels. Contact with the cavity wall imparts sufficient torque to urge the projectile back toward the center of the cavity.

BRIEF DESCRIPTION OF THE DRAWINGS

FIG. 1A depicts a perspective view of a projectile in accordance with the illustrative embodiment of the present invention, wherein deployable fins of the projectile are in a stowed state.

FIG. 1B depicts a front end view of the projectile of FIG. 1A.

FIG. 2A depicts the projectile of FIG. 1A wherein the fins are in a deployed state.

FIG. 2B depicts a front end view of the projectile as shown in FIG. 1A.

DETAILED DESCRIPTION

Figure 3B:
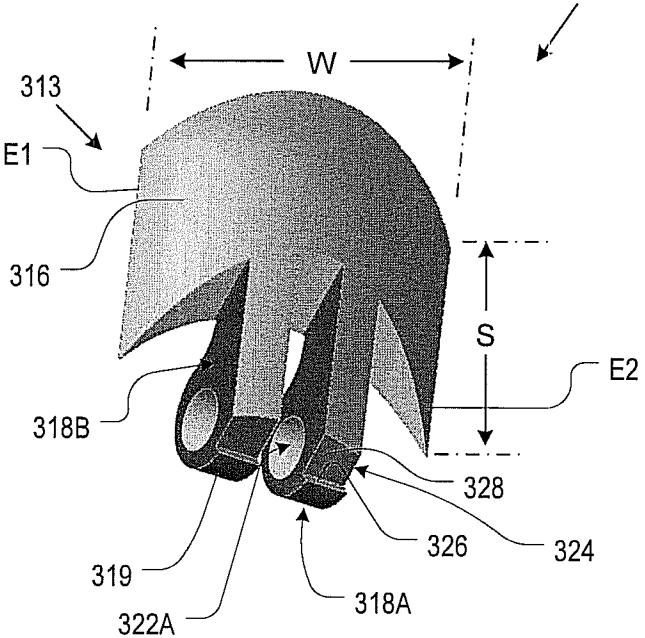
FIG. 3B depicts a back perspective view of one of the deployable fins.

The following terms are defined for use in the description and the appended claims as follows:

"Chord" or "Chord length" means, in the context of a fin, the distance from the front (or leading edge) of the fin to the back (or trailing edge) of the fin. The chord is parallel to the longitudinal axis of the projectile.

"Longitudinal axis" means, in the context of a projectile, an axis aligned with the length (nose to tail) of the projectile.

"Major surface" means, in the context of a fin, the (two) surfaces having an area that is a function of the span of the fin and the width of the fin, as the terms "span" and "width" are defined herein.

"Projectile" means any artificial body, either powered, such as by a motor, or un-powered, such as a bullet, etc.

"Root" means, in the context of a fin, the portion of the fin that is nearest to the body of the projectile when the fin is deployed.

"Span" means, in the context of a fin, the distance between the tip and the root of the fin.

"Substantially" means, in the context of an angular deviation, ±10 degrees.

"Supercavitating projectile" means a projectile that, when moving under water at sufficient speed, is enveloped by a gaseous cavity that the projectile itself generates.

"Tip" means, in the context of a fin, the portion of the fin that is furthest from the body of the projectile when the fin is deployed.

"Width" means, in the context of a fin, the straight-line distance between opposed edges of a fin, wherein (a) the opposed edges do not include the tip or root of the fin and (b) a line connecting the opposed edges is not parallel to longitudinal axis of the projectile. If the line connecting the opposed edges of the fin were parallel to the longitudinal axis of the projectile, the opposed edges would be the leading and trailing edge of the fin and the distance defined here as "width" would be properly characterized as the "chord" or "chord length" of the fin.

Definitions of other terms and phrases may appear elsewhere in this disclosure.

FIG. 1A depicts a perspective view of supercavitating projectile 100 in accordance with the illustrative embodiment. Projectile 100 comprises nose 102, body 108, fin recess 110, and fin 112, interrelated as shown.

Blunt forward end 104 of nose 102 is used to create the vaporous cavity that encompasses projectile 100 during supercavitating operation, in known fashion. For that reason, in the context of a supercavitating projectile, the forward end of the nose is typically referred to as a "cavitator." In the illustrative embodiment, cavitator 104 is flat; however, in other embodiments, other structural arrangements for the cavitator may suitably be used. See, for example, U.S. patent application Ser. Nos. 12/102,784 and 12/102,781, incorporated by reference herein.

In the illustrative embodiment, nose 102 has "stepped" profile 106. The stepped profile results from configuring at least the forward portion of nose 102 as a plurality of substantially right-circular cylindrical shells or segments that increase in diameter progressively moving aft. The stepped profile of the nose can provide certain advantages as a function of the projectile's yaw angle. Other structural arrangements for the nose may suitably be used. See, for example, U.S. patent application Ser. Nos. 12/102,784 and 12/102,781.

Body 108 is substantially cylindrical in shape. In some embodiments, body 108 houses a propellant bay (not depicted). The propellant bay contains a chemical propellant, typically (e.g., ammonium perchlorate, etc.) that is ignited to generate the energy for launch. The aft end of body 108 includes plural recesses 110 for accommodating a plurality of fins 112. In the illustrative embodiment, projectile 100 has three fins 112.

In FIG. 1A, fins 112 lie in-plane with the exterior of body 108, substantially parallel to longitudinal axis A-A and substantially flat against projectile 100 in recesses 110. This orientation defines the "stowed" position or state of fins 112. FIG. 1B is a front end view of projectile 100. As seen from FIG. 1B, when fins 112 are in their stowed position, they do not project beyond the circumference of body 108.

FIGS. 2A and 2B depict projectile 100 with fins 112 rotated out-of-plane from the surface of body 108 and away from the recess 110. This defines the "deployed" position or state of fins 112. As depicted in the front end view of FIG. 2B, fins 112 project beyond the circumference of body 108 when they are in the deployed state.

Figure 3A:
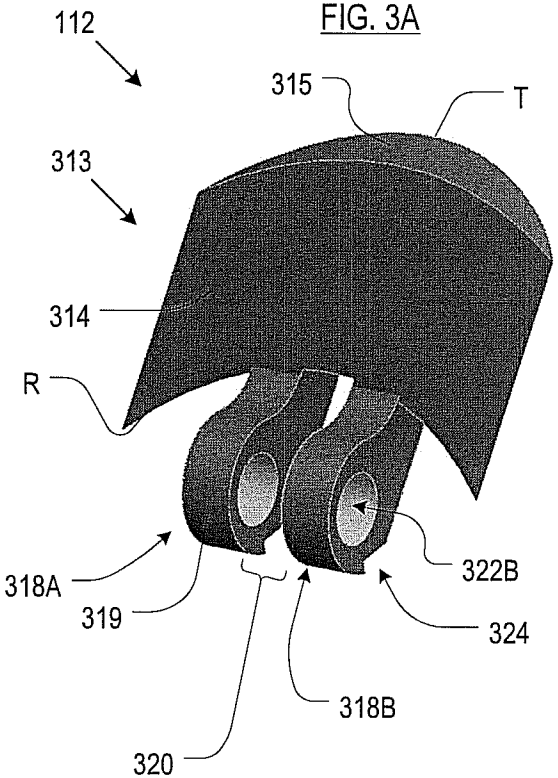
FIG. 3A depicts a front perspective view of one of the deployable fins.

FIGS. 3A and 3B depict, via respective front and rear perspective views, further details of fin 112. Referring now to both drawings, fin 112 comprises body portion 313 and shoulders 318A and 318B, interrelated as shown.

Body portion 313 of the fin 112 has two major surfaces; front surface 314 and rear surface 316. In the embodiment depicted in FIGS. 3A and 3B, front surface 314 has a concave shape and rear surface 316 has a convex shape. Note that in FIGS. 2A, 3A, and 6, front surface 314 is depicted as having a concave shape. In other embodiments, front surface 314 is flat, so as to mate flush with recess 110 (see, e.g., FIG. 5A, etc.). Regardless of the shape of front surface 314, rear surface 316 maintains its curved shape to smoothly integrate with the exterior of body 108.

Body portion 313 is characterized by tip T, root R, span S, and width W. The distance characterized as "width W" would properly be termed the "chord" of fin 112 if the fin were oriented in the manner of a typical fin, wherein the edges E1 and E2 were accurately characterized as the leading edge and trailing edge of the fin. But as depicted in FIG. 2A, for example, edges E1 and E2 of the fin are offset by ninety degrees relative to a typical projectile fin. Normally, fin orientation is a function of aerodynamics; fins would not be oriented so as to present a major surface to "on-coming" fluid. Rather, a major surface would be oriented parallel to the direction of movement (of the fluid or projectile) to avoid what would otherwise be a large drag force. In the accordance with the illustrative embodiment, however, fin orientation is a function of the deployment mechanism; aerodynamics are not of particular concern. In fact, from the perspective of aerodynamics, the fins 112 have the worst possible orientation, in the sense that the ratio of the width of fin 112 to the chord of fin 112 is greater than 1. Note that due to the way in which fins 112 are oriented, the dimension that is referred to as the chord of fin 112 would, in a typical fin orientation, be the thickness of fin 112. And, as previously noted, the dimension that is referred to as the width of fin 112 would, in a typical fin orientation, be the chord of fin 112.

Portion 315 of front surface 314 near tip T is tapered wherein the thickness of body portion 313 decreases to a minimum at tip T. In some embodiments, a portion of rear surface 316 near tip T is tapered as well (see, e.g., FIGS. 5A and 5B). Root R of body portion 313 is curved. In the illustrative embodiment, this curve precisely matches the curved shape of body 108. As described in further detail later in this specification, the matching curved surfaces of root R and body 108 functions to support fins 112 when they are in the deployed state.

Shoulders 318A and 318B depend from root R of body portion 313. The shoulders are separated by space 320. Extending away from root R of body portion 313, shoulders 318A and 318B enlarge to accommodate respective pivot-pin receiving holes 322A and 322B.

Edge 319 of shoulders 318A and 318B is a contoured surface that defines a cam, as discussed later in this specification in conjunction with FIGS. 5A and 5B. Viewed from the front of fin 112 (i.e., as in FIG. 3A), edge 319 defines a smooth curve until region 324, wherein edge 319 juts abruptly inward defining wall 326. Edge 319 then continues at an angle (typically, but not necessarily, 90 degrees, ±about 20 degrees) relative to wall 326, defining surface 328. This surface is substantially parallel to the tangent of the "circle" defined by hole 322A (or 322B) at the point at which face 326 would intersect the hole, if face 326 were so projected.

Figure 4:
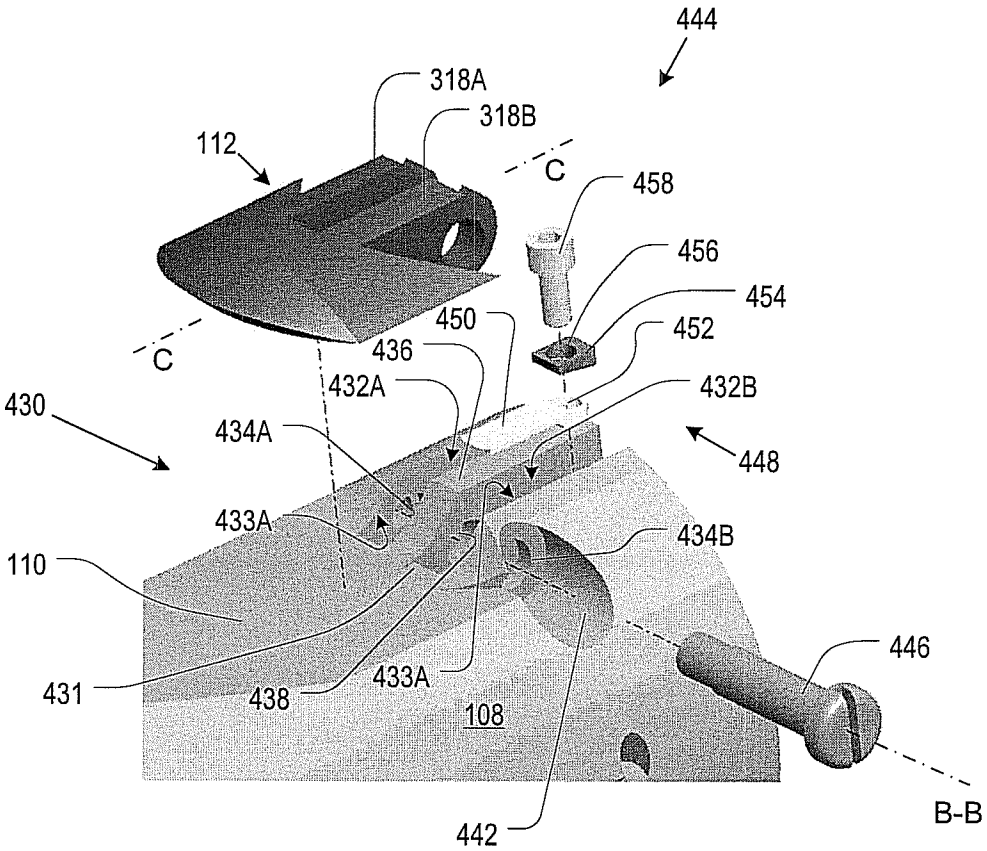
FIG. 4 depicts an exploded view of the aft end of the projectile of FIG. 1A.

FIG. 4 depicts fin-receiving region 430 disposed at the aft portion of body 108 and further depicts, via an exploded view, the fin assembly, indicated generally at 444. The fin assembly includes fin 112, pin 446, and cam-follower assembly 448.

Fin-receiving region 430 is physically adapted to receive fin assembly 444. Specifically, fin-receiving region 430 includes recess 110, channels 432A and 432B, and access hollow 442.

Recess 110 is dimensioned and arranged to accommodate fin 112 in the stowed state. The recess is sufficiently deep so that when fin 112 is stowed, rear surface 316 of fin body 313 aligns with the surface of body 108. In the illustrative embodiment, the curvature of rear surface 316 matches that of body 108 to provide a smooth, essentially continuous surface when fin 112 is stowed.

Channels 432A and 432B, which align directionally with longitudinal axis A-A of projectile 100 (see, FIG. 1A), are disposed proximal to and aft of recess 110. The channels are spaced apart and so define tab 436. Pivot-pin receiving hole 434A is disposed in wall 433A at the forward portion of channel 432A, which is proximal to aft edge 431 of recess 110. Similarly, pivot-pin receiving hole 434B is disposed in wall 433B at the forward portion of channel 432B. Pivot-pin receiving hole 438 is disposed in tab 436 proximal to aft edge 431 of recess 110. Holes 434A, 434B, and 438 are axially aligned with one another along axis B-B.

Fin 112 is pivotally coupled to projectile 100 as follows. Shoulders 318A and 318B are received by respective channels 432A and 432B. Fin 112 and fin-receiving region 430 are dimensioned and arranged so that when the fin's shoulders are received by channels 432A and 432B, pivot-pin receiving holes 422A and 422B in the shoulders and pivot-pin receiving holes 434A, 434B, and 438 in fin-receiving area 430 are axially aligned with one another along axis B-B to collectively receive pivot pin 446. In this fashion, fin 112 is pivotally coupled to projectile 100. Access hollow 442, which in the illustrative embodiment is proximal to hole 434B, provides access to the pivot-pin receiving holes to insert pivot pin 446.

With continued reference to FIG. 4, disposed within channel 432B is cam follower assembly 448 which, in the illustrative embodiment, comprises leaf spring 450, locking element 454, and fastener 458. In the illustrative embodiment, locking element 454 is a locking wedge and fastener 458 is a set screw. Fastener 458, which passes through hole 456 in locking element 454 and hole 452 in leaf spring 450, is ultimately threaded into (or otherwise secured to) the base of the channel. Although cam follower assembly 448 is disposed in channel 432B in the illustrative embodiment, it is to be understood that the cam follower assembly could alternatively be disposed in channel 432A. Furthermore, in some embodiments, a cam follower assembly is disposed in both channels 432A and 432B. Cam follower assembly 448 and its operation are discussed further below with respect to FIGS. 5A and 5B.

Figure 5A:
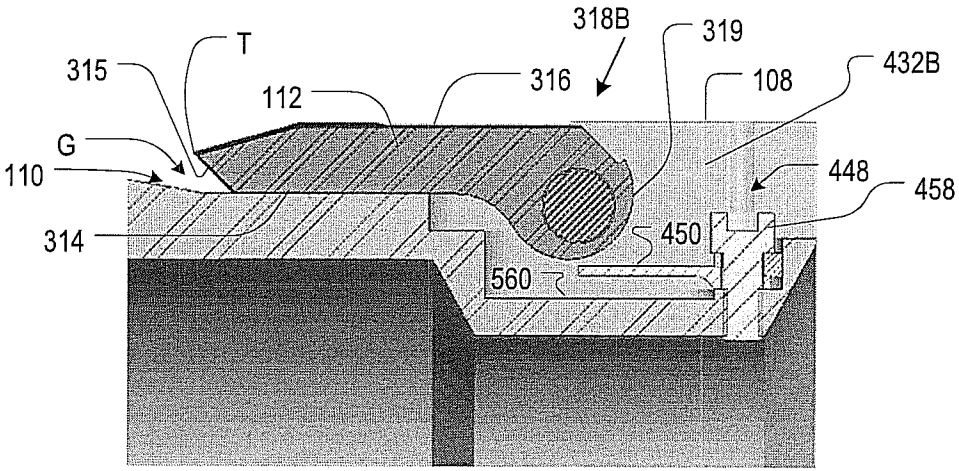
FIG. 5A depicts a side cross-sectional view of the aft end of the projectile of FIG. 1A, wherein the fin is shown in a stowed state.
Figure 5B:
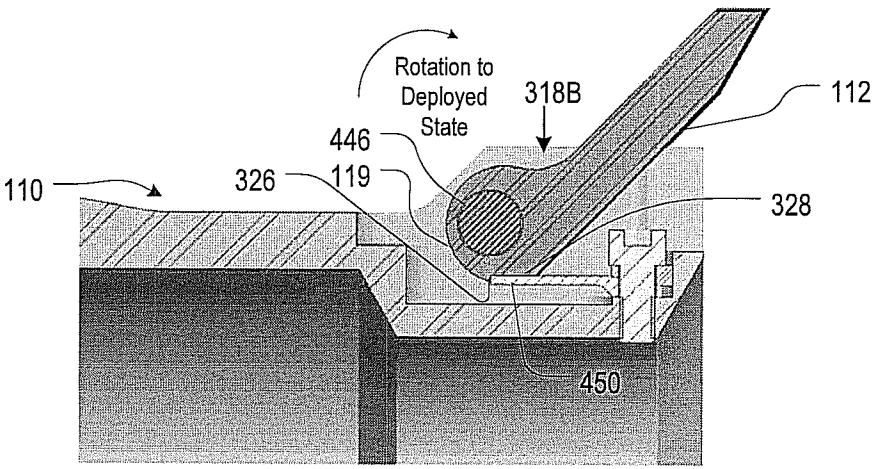
FIG. 5B depicts a side cross-sectional view of the aft end of the projectile of FIG. 2A, wherein the fin is shown in a deployed state.

FIGS. 5A and 5B depict a cross-sectional side view through fin-receiving region 430 along the mid-line of channel 432B and through axis C-C of fin 112 shown in FIG. 4, but when the fin is actually pivotally coupled to projectile 100. More specifically, these Figures depict recess 110 and a view into channel 432B, as well as a cross sectional view of fin body 113, fin shoulder 318B, and cam follower assembly 448.

FIG. 5A depicts fin 112 in a stowed state. In this state, forward surface 314 of the fin abuts the surface of recess 110 and rear surface 316 of fin body 103 is approximately coplanar with the surface of projectile body 108. Gap G is formed between the surface of recess 110 and tapered portion 315 of fin 112 near tip T thereof.

FIG. 5A also depicts cam follower assembly 448 in channel 432B. Leaf spring 450 of cam follower assembly 448 is spaced above bottom 560 of channel 432B, enabling the leaf spring to deflect downward. Fastener 458 is shown in threaded engagement with base 560 of channel 432B.

FIG. 5B depicts fin 112 in the deployed state. To attain this state from the stowed state depicted in FIG. 5A, fin 112 partially rotates about pivot pin 446. Rotation of fin 112 from the stowed to the deployed state occurs when projectile 100 contacts water after leaving the barrel from which it is fired or launched. Rotation occurs as a consequence of the drag forces experienced at gap G. In some embodiments, a "spring-biasing" element (not depicted in FIG. 5*b*; see FIG. 6) urges fin 112 away from recess 110 to begin its rotation to the deployed state as projectile 100 leaves its launch tube.

In the illustrative embodiment, fin 112 rotates about 135 degrees from the stowed state to the deployed state. At some point during rotation of fin 112, surface 319 of shoulder 318B engages leaf spring 450. As the fin continues to rotate, leaf spring 450 flexes downwardly (toward base 560), with maximum flexure occurring as region 324 of cam surface or edge 319 (see also, FIGS. 3A and 3B) contacts leaf spring 450. At this point, surface 319 juts inward abruptly, releasing the flex in leaf spring 450 such that the leaf spring forcibly rebounds, engaging flat cam surface 328.

Once cam surface 328 and leaf spring 450 engage, as depicted in FIG. 5B, fin 112 is effectively prevented from rotating back toward recess 110. This prevents fin 112 from "chattering" when the projectile is underway.

Figure 6:
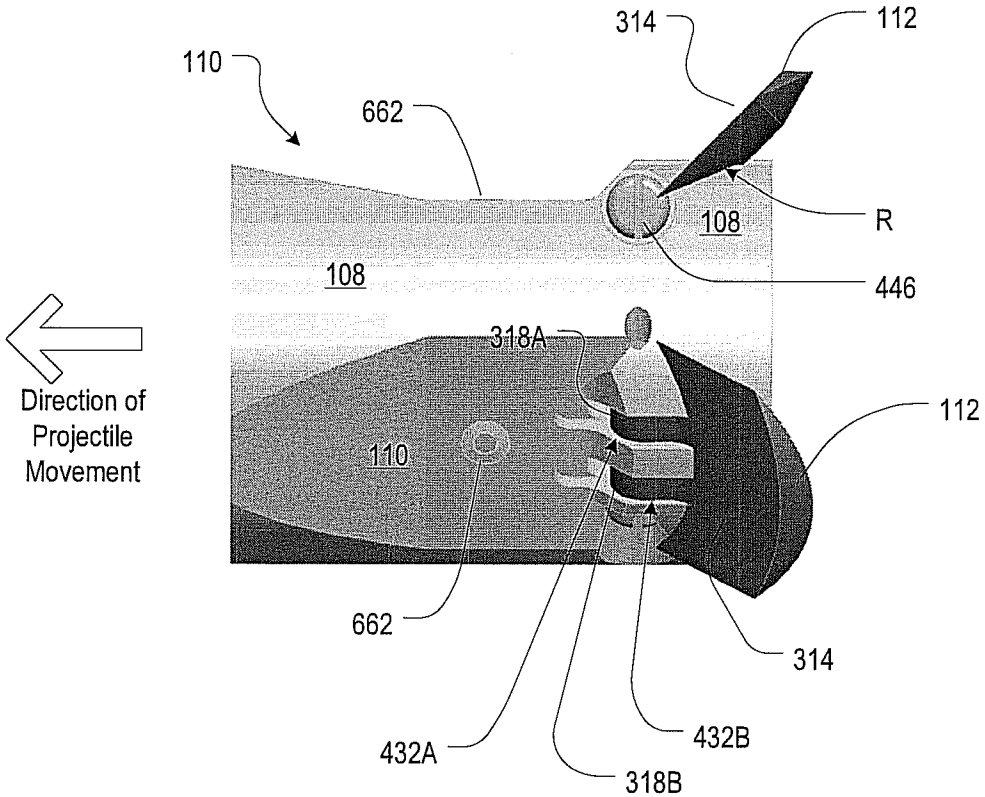
FIG. 6 depicts a perspective view of the aft end of the projectile of FIG. 2A, wherein the fins are shown in a deployed state.

FIG. 6 depicts a perspective view of the aft end of projectile 100, showing two of fins 112 in the deployed state. Drag on front surface 314 of fin 112 forces the fin back until root R engages the surface of body 108. The body of projectile 100 itself therefore supports fins 112 once they deploy.

FIG. 6 depicts optional spring-biasing element 662, which in the illustrative embodiment is a cupped spring washer or cone washer, also known as a Belleville washer. This non-flat washer has a slight conical shape that gives the washer a spring-like characteristic. As projectile 100 is loaded into its launch tube, fin 112 is forced against spring-biasing element 662 such that the spring-biasing element is compressed. When projectile 100 is fired from its launch tube, spring-biasing element 662 returns to its pre-compressed shape, releasing its stored energy. This imparts an impulse to fin 112. Since fin 112 is pivotally attached to projectile 100, this impulse causes the free end of fin 112 to move away from recess 110, wherein the fin begins to rotate about pivot pin 446. As fins 112 begin to rotate away from recess 110, the water drag forces the fins back until root R of the fins abuts the surface of body 108.

In embodiments in which spring-biasing element 662 is not used, gap G, as depicted in FIG. 5A, permits water to contact tapered surface 315 of fin 112, thereby causing sufficient drag to deploy the fin.

The following provides an example of a supercavitating projectile in accordance with the illustrative embodiment.

Diameter of body 108: 40.0 mm (1.57 in)
Diameter of cavitator 104: 7.62 mm (0.3 in)
Length of projectile 100: 483 mm (19.0 in)
Center of Gravity: 279 mm (11.0 in) from cavitator
Fin span: 57.2 mm (2.25 in)
Propellant bay: 230 grams (8 ounces)
Mass of projectile 100 1.93 kg (4.25 lbs)
Material of Construction:
Nose: S7 Tool Steel
Body: S7 Tool Steel
Fins: Titanium
Leaf Spring Buckling Load: 360 Newtons (81 lbf)
Pivot Pin, design pressure: 620.6 MPa (90 Kilopounds/sq in.)

Those skilled in the art will understand that to design a supercavitating projectile, such as those described herein, requires computational fluid dynamic analysis to determine operational stability, etc. These calculations must consider nominal projectile operating depth and yaw angle. Such analysis is within the capabilities of those skilled in the art.

Figure 7:
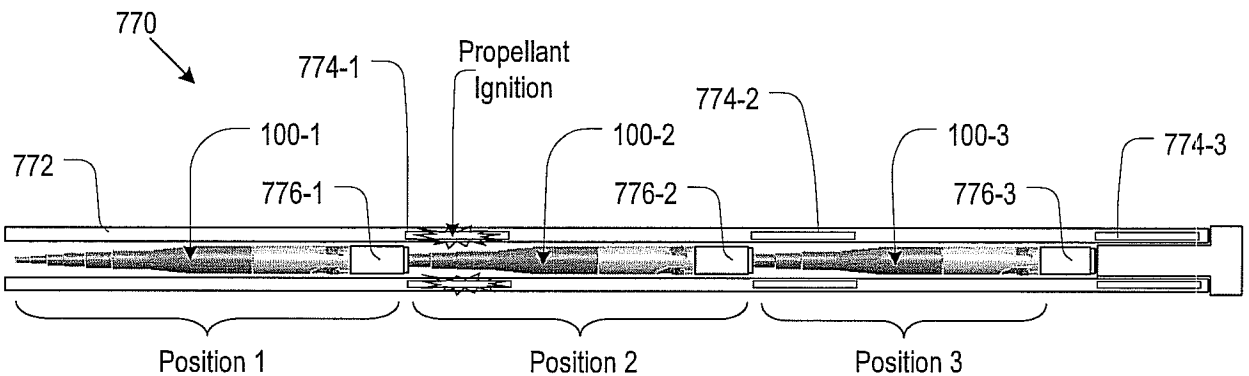
FIG. 7 depicts a side view of a launcher container a plurality of the projectiles disclosed herein, wherein the projectiles are disposed in a stacked launcher configuration.

The positioning of fins 112 forward of the aft end of projectile 100 (see, e.g., FIG. 1A, etc.) enables projectiles 100 to be used in conjunction with a stacked projectile launcher, a stylized representation of which appears in FIG. 7. Such a launcher is available from Metal Storm Ltd. Of Brisbane, Australia.

Launcher 770 accommodates multiple projectiles that arranged nose-to-tail within barrel 772. In the illustrative embodiment depicted in FIG. 7, three projectiles 100-1, 100-2, and 100-3 are stacked in respective positions 1, 2, and 3.

Within barrel 772 is a plurality of propellant bays 774-1, 774-2, 774-3 (collectively or generally, "propellant bay(s) 774"). In the illustrative embodiment, each propellant bay is configured as a ring-shaped cavity within barrel 772 that is filled with propellant. Gas ports (not depicted) lead from the propellant bay to the bore of barrel 772.

Projectiles 100 are separated from one another in barrel 772 by "pusher plugs" 776. That is, pusher plug 776-1 is aft of projectile 100-1 and forward of projectile 100-2. Pusher plug 776-2 is aft of projectile 100-2 and forward of projectile 100-3, etc.

There is one propellant bay 774 for each projectile position, such that each propellant bay contains the propellant responsible for launching an associated projectile. For example, propellant bay 774-1 contains the propellant that is used to launch projectile 100-1 in Position 1. Launcher 770 is designed so propellant bay that is associated with a particular projectile is located just aft of the pusher plug for that projectile.

As previously noted, it is the positioning of fins 112 forward of the aft end of projectile 100 (see, e.g., FIG. 1A, etc.) that enables projectiles 100 to be used in conjunction with stacked projectile launcher 770. In particular, if the fins folded behind the aft end of projectile 100, there would be no way to stack the projectiles while providing sufficient structural rigidity.

Furthermore, in some embodiments, projectile 100 contains a booster that is ignited once the projectile leaves barrel 772. In those embodiments, fins 112 are disposed circumferential of a propellant bay disposed proximal to the aft end of the projectile. A benefit of fins 112 disclosed herein is that when deployed, the exhaust gas from the ignited booster never impinges on fins 112 since the fins are forward of the exhaust nozzle of the projectile.

It is to be understood that the disclosure teaches just one example of the illustrative embodiment and that many variations of the invention can easily be devised by those skilled in the art after reading this disclosure. For example, after reading this specification, those skilled in the art will know how to design alternative embodiments of the present invention in which projectile 100 is a torpedo or a projectile that is fired in air and then penetrates the water, in which the fins are located other than at the tail of projectile 100, etc. As a consequence, the scope of the present invention is to be determined by the following claims.

What is claimed is:

1. A projectile comprising:
a nose, wherein the forward surface of the nose comprises a cavitator for creating a gaseous cavity inside a water medium;
a body, wherein the nose depends from the body; and
a fin pivotally coupled to the body, the fin having a stowed position and a deployed position, and wherein a width-to-chord ratio of the fin is greater than one.

2. The projectile of claim 1 and further comprising a recess in an exterior surface of the body of the projectile, wherein in the stowed position, the fin is disposed in the recess.

3. The projectile of claim 2 further comprising a coupling for pivotally coupling the fin to the body, wherein the coupling comprises:
two spaced-apart channels disposed in the surface of the projectile aft of the recess;
a plurality of axially-aligned holes, wherein the holes are formed in walls defined by the channels; and
a pivot pin, wherein the pivot pin is received by the holes.

4. The projectile of claim 3 and further wherein the fin comprises:
a fin body; and
two shoulders that depend therefrom, wherein the shoulders each have a hole that is dimensioned and arranged to receive the pivot pin, thereby pivotally connecting the fin to the coupling.

5. The projectile of claim 4 wherein an edge of at least one of the shoulders defines a cam, wherein during deployment of the fin, the cam couples to a cam follower, wherein when coupled, the cam follower prevents the fin from rotating back toward the recess.

6. The projectile of claim 1 and further wherein the fin is dimensioned and arranged so that the body of the projectile supports the fin against fluid drag forces when the fin is deployed.

7. A projectile comprising:
a nose, wherein the forward surface of the nose comprises a cavitator for creating a gaseous cavity inside a water medium;
a body, wherein the nose depends from the body; and
a deployable fin that deploys from a stowed position to a deployed position, wherein a width-to-chord ratio of the fin is greater than one; and
a coupling, wherein the deployable fin is pivotally coupled to the projectile's body by the coupling, and wherein the coupling has a single degree of freedom about an axis of rotation that is perpendicular to a longitudinal axis of the projectile.

8. The projectile of claim 7 wherein the deployable fin is forward of an exhaust nozzle of the projectile and circumferential to a propellant bay within the body of the projectile.

9. The projectile of claim 7 and further wherein the fin is dimensioned and arranged so that the body of the projectile supports the fin against fluid drag forces when the fin is deployed.

10. A projectile comprising:

a nose, wherein the forward surface of the nose comprises a cavitator for creating a gaseous cavity inside a water medium;

a body, wherein the nose depends from the body; and a deployable fin that deploys from a stowed position to a deployed position, wherein a width-to-chord ratio of the fin is greater than one, and wherein the fin comprises:

a fin body; and two shoulders that depend therefrom, wherein the shoulders each have a hole that is dimensioned and arranged to cooperate with a coupling to pivotally connect the fin to the body of the projectile, and wherein an edge of at least one of the shoulders defines a cam, wherein during deployment of the fin, the cam couples to a cam follower, wherein when coupled, the cam follower prevents the fin from rotating back toward the recess.

11. The projectile of claim 10 wherein the deployable fin is forward of an exhaust nozzle of the projectile.

12. The projectile of claim 10 further comprising the coupling, wherein the deployable fin is pivotally coupled to the projectile's body by the coupling, and wherein the coupling has a single degree of freedom about an axis of rotation that is perpendicular to a longitudinal axis of the projectile.

13. The projectile of claim 10 and further wherein the fin is dimensioned and arranged so that the body of the projectile supports the fin against fluid drag forces when the fin is deployed.

* * * * *